United States Patent [19]

Rehr

[11] 4,078,737

[45] Mar. 14, 1978

[54] APPARATUS FOR MANUFACTURING TEXTILE COILS HAVING PREDETERMINED THREAD LENGTH

[75] Inventor: Winfried Rehr, Monchen-Gladbach, Germany

[73] Assignee: W. Schlafhorst & Co., Monchen-Gladbach, Germany

[21] Appl. No.: 642,488

[22] Filed: Dec. 19, 1975

[30] Foreign Application Priority Data

Dec. 19, 1974 Germany ..... 2460252

[51] Int. Cl.[2] ..... B65H 63/08

[52] U.S. Cl. ..... 242/39; 57/80; 235/92 PD

[58] Field of Search ..... 242/39, 36, 37, 40, 242/28, 29, 30, 49; 57/34 R, 80; 235/92 PD, 92 T

[56] References Cited

U.S. PATENT DOCUMENTS

| | | | |
|---|---|---|---|
| 2,708,553 | 5/1955 | Dyer | 242/39 X |
| 3,344,408 | 9/1967 | Singer et al. | 235/92 PD X |
| 3,445,837 | 5/1969 | Lyons | 242/36 X |
| 3,648,026 | 3/1972 | Abe et al. | 242/36 X |
| 3,648,027 | 3/1972 | Ganong, Jr. et al. | 242/36 X |
| 3,739,996 | 6/1973 | Matsui et al. | 242/39 |
| 3,765,988 | 10/1973 | Schaffer et al. | 242/36 X |

FOREIGN PATENT DOCUMENTS

| | | | |
|---|---|---|---|
| 1,131,749 | 10/1968 | United Kingdom | 242/36 |

*Primary Examiner*—Stanley N. Gilreath
*Attorney, Agent, or Firm*—Herbert L. Lerner

[57] ABSTRACT

A method of manufacturing textile coils having a predetermined thread length in a textile machine having a plurality of individual work stations operating at a predetermined speed, which includes establishing a given value for the working time of each individual work station from a predetermined thread length and working speed, continuously measuring the shutdown time of each individual work station, adding the shutdown time to the working time to provide a total operating time, and stopping the respective work station when the nominal value of the total operating time is reached; and apparatus for carrying out the foregoing method.

5 Claims, 1 Drawing Figure

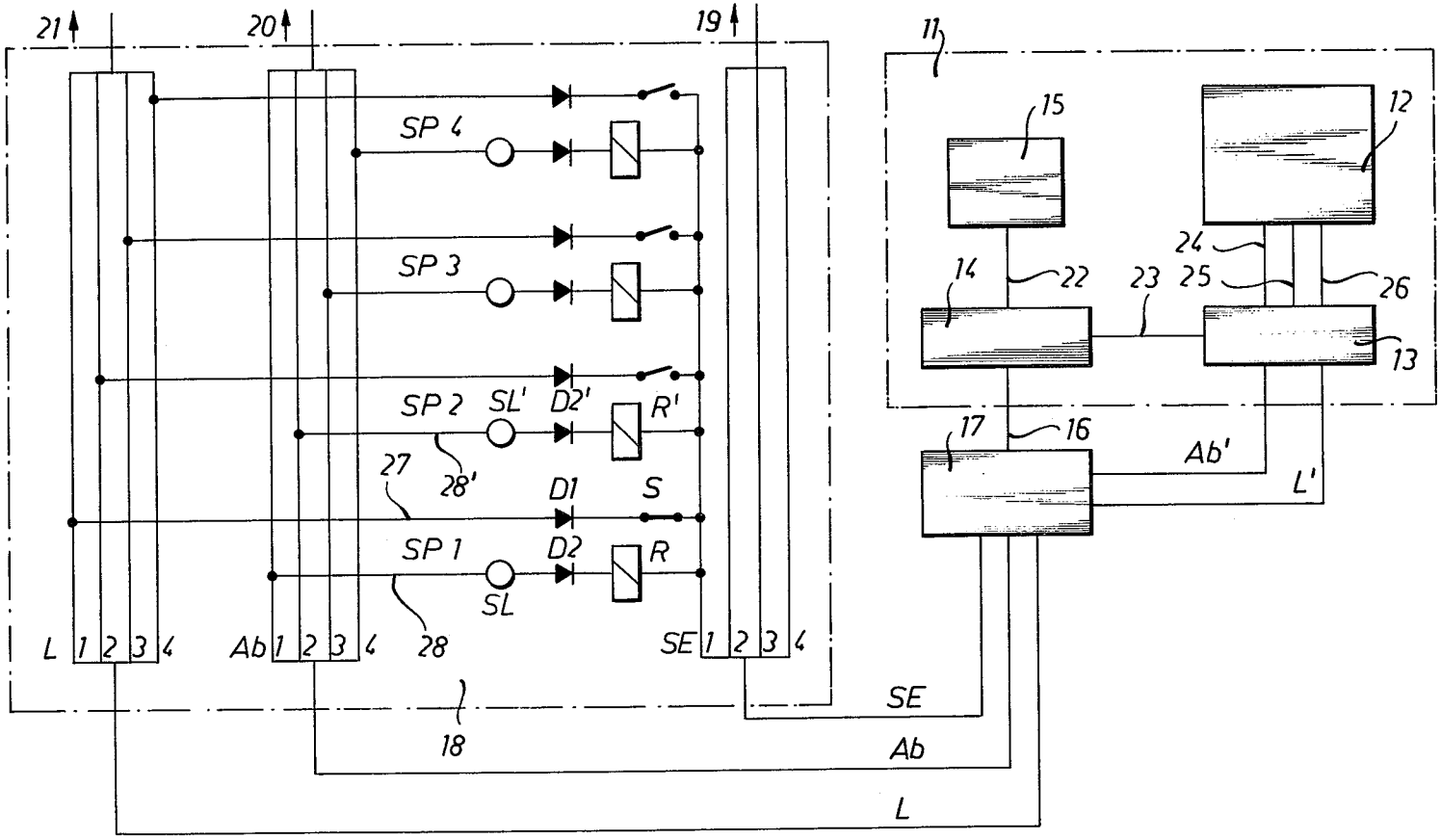
11
12
13
14
15
16
17
18
19
20
21
22
23
24
25
26
L'
Ab'
SE
Ab
L
SP 4
SP 3
SP 2
SP 1
SL'
SL
D2'
D1
D2
R'
S
R
27
28
28'

APPARATUS FOR MANUFACTURING TEXTILE COILS HAVING PREDETERMINED THREAD LENGTH

BACKGROUND OF THE INVENTION

1. Field of the Invention

The invention relates to a method and apparatus for manufacturing textile coils having predetermined thread length in a textile machine which has individual work stations, such as winding stations, particularly.

Rising raw material prices for textile fibers and increasing labor costs increasingly necessitate measurements of the length of the textile threads during production and rewinding. It is the purpose of this length measurement to produce coils of equal thread length, so that thread remainders during warping or weaving remain minimal, and tying time is saved.

2. Description of the Prior Art

Devices for measuring the thread length winding and multiple spooling machines have been known for a long time. They operate, for example, so that a transmitter rotating together with the parts of the machine delivers pulses which are counted and compared with a reference value. The number of the counted pulses is a measure of the length of the thread.

A disadvantage is consequently encountered in that a pulse transmitter as well as a pulse counter must be provided at every work station of the textile machine. The capacity of the counter must be selected so as to be sufficiently large because, in the case of large coils, a large number of pulses is delivered to the detection unit. A further drawback in this connection is that the pulses enter the detection system asynchronously because of the difference in the angular velocities. If the detection unit is to be disposed separate from the work station, each work station must be connected with the detection unit through a separate data line, which means additional high costs for installation materials.

The invention of the instant application remedies this situation. It is an object of the invention to avoid the foregoing disadvantages of the heretofore known length measuring devices and to provide an improved method and less expensive apparatus for the manufacture of textile coils having predetermined thread length.

SUMMARY OF THE INVENTION

With the foregoing and other objects in view, there is provided, in accordance with the invention, a method of manufacturing textile coils having a predetermined length, which comprises determining a desired value of the working time of each individual work station from the predetermined thread length and the working speed, continuously measuring the shutdown times of each individual work station, adding the shutdown times to the working time, and stopping the respective work station upon reaching the desired value of the working time corrected to provide a total operating time. It is evident that data acquisition and processing are simplified through the use of the method of the invention. Although the work station may be a station at which a thread may be drawn-out wound, unwound, twisted, spooled, warped, slashed and the like, the invention is described hereinafter only with respect to a winding station and a winding operation. If the winding operation or process proceeds without disturbance, the originally determined desired value of the working or winding time is not corrected or changed at all, provided that the working or winding speed also remains constant.

In accordance with another mode of the method of the invention, a further simplification of the data acquisition and processing is achieved by ascertaining the shutdown times of each individual work or winding station by pulse counting. For ascertaining the shutdown times, it is advantageous to use a data acquisition system or apparatus for the computation and correction of the desired value of the winding time and for stopping the respective winding station when the predetermined thread length of the wound textile coil is reached. The winding stations are preferably combined into groups of ten, interrogated through address lines leading from the data acquisition apparatus or measuring data switch (multiplexer) thereof to the respective groups, and the information content, indicating "winding station stopped" or "winding station running", is accepted sequentially in time into the acquisition unit of the data acquisition apparatus.

If an integral multiple of the winding velocity is selected as interrogation cycle, a direct measure is obtained, for example, in meters, for the thread length that may have dropped out during the shutdown time. In practice, the unit of time of one second is advantageously selected as the interrogation cycle.

A heretofore known multiplexer or measuring point switch can be used for interrogating the shutdown periods. It is advantageous to use a shutoff device already available at the winding station or work station, such as, for example, a thread cutting device, a textile coil ejector device, or a roving interruption device for shutting down the winding station when the predetermined thread length of the wound textile coil is attained. The lastmentioned device would be used for stopping a spinning frame.

Error-free monitoring and measuring of the thread length and shutdown time of all winding stations must be assured. It is therefore additionally proposed, in accordance with a further feature of the invention, that the renewed start-up of the winding station or work station, after shut-down because the predetermined thread length was attained, is made possible only if the device for determining and correcting the desired or nominal value of the winding time is made operative at the same time. Assurance is thereby providing that the monitoring of the thread length begins anew with each new winding operation.

In accordance with the apparatus of the invention for implementing the foregoing method of the invention a measured-data transmitter for measuring the shutdown time periods is located at each winding station. The measured-data transmitter is connected to a data processing system which increases the desired or nominal value of the winding time formed from the predetermined thread length and the winding speed by adding the measured shutdown time so as to yield a total operating time, and stops the winding station when the total operating time is reached. For interrogating or for controlling the measured-value transmitter, it is advantageous to dispose a timer or machine-cycle device at a central point.

The timing thus is determined either by a clock or by the speed of rotation or the thread feeding velocity of the textile machine. In the latter case, a completely uniform machine cycle is not absolutely necessary.

In accordance with an added feature of the invention, the data processing system or measuring-point switch thereof is connected to the winding stations through data channels that are provided with taps, the total number of line conductors of the data channels being smaller than the number of winding stations of the textile machine. Accordingly, connecting lines ae economized, in an advantageous manner.

Beginning with a predetermined thread length, if the winding operation is undisturbed, the computing mechanism of the data processing system can determine the prospective winding time. This computing mechanism can be used in common by all winding stations of the textile machine, so that it is sufficient to provide only one computing mechanism for the entire textile machine or even for an entire group of textile machines. Shutdown times that occur are stored separately for each winding station. It is thereby of special importance to store data in the storage locations in the sequential order of the work stations, so that a direct image or replica of the textile machine is present also in the acquisition unit.

It is furthermore advantageous to provide a storage location with the starting time of the winding process of each work station or winding station, so that the respective remaining winding time can be determined.

The herein aforedescribed data acquisition and processing is readily attainable with a digital computer wherein the operating memories of the data storage device store the shutdown times. Instead of such a digital computer, a simple computing mechanism after-connected by a hardware memory unit of semiconductor elements can also be used.

The invention advantageously affords simplified data acquisition and processing for the purpose of producing textile coils having predetermined thread length.

Other features which are considered as characteristic for the invention are set forth in the appended claims.

BRIEF DESCRIPTION OF THE DRAWING

Although the invention is illustrated and described herein as embodied in a method and apparatus for manufacturing textile coils having predetermined thread length, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the single FIGURE of the drawing schematically showing a representative portion of the system of the present invention.

DESCRIPTION OF THE PREFERRED EMBODIMENT

Referring now to the drawing, there is shown a data processing system 11, constructed as a process computer which comprises a known suitable data storage device 12, an arithmetic unit 13, a control unit 14 and a timing mechanism or clock 15.

Through data channels 16, Ab' and L', a measuring-point switch (multiplexer) 17 is connected to the process computer 11. An example of a typical multiplexer circuit that may be utilized is shown on page 152 of the Sourcebook of Electronic Circuits, published by McGraw Hill, 1968. The testile machine is subdivided into as many units as desired (four units in the illustrated embodiment) of preferably ten winding stations SP each, (four of which are shown in the FIGURE). A first textile machine unit 18, formed of the four winding stations SP1 to SP4, is shown schematically in the FIGURE, with only those parts which are necessary for an understanding of the invention. At each winding station SP1 to SP4, there are a signal lamp SL, a relay R, a switch S, representing the measured-value transmitter, which may be provided by a simple logic or gate circuit, and two diodes D1 and D2. The measuring point switch 17 is connected to the machine unit 18 through data channels SE, AB and L. As shown by the direction of arrows 19, 20 and 21, the data channels also lead to the succeeding machine units, with the data channels Ab and L being continued to all the wires. One line from the data channel SE ends at each machine unit, with the line SE1 ending at the first machine unit 18. Within the process computer 11, a data channel 22 connects the timer or clock 15, which provides a suitable source of timing pulses, with the control unit 14, a data channel 23 connects the control unit 14 with the arithmetic unit 13, and three data channels 24, 25 and 26 connect the arithmetic unit 13 with the data storage device 12.

Individual storage cells of a suitable conventional type, such as shift registers, are advantageously disposed in the data storage device 12 in the order of the machine units and in the order of the winding stations within the machine units. A working storage location is provided for each individual winding station, the addressing being performed by the measuring point switch (multiplexer) 17 according to the numbered order of the winding stations. For example, the storage location No. 1 is assigned to the winding station SP1 of the first machine unit 18, the storage location No. 2 to the winding station SP2 also of the first machine unit 18, the storage location No. 5, in this example, to the first winding station of the second machine unit (both nonillustrated) and so forth. In practice, ten winding stations are advantageously combined into each machine unit, the illustrated embodiment being a simplification thereof. Thus, a direct image or replica of a data acquisition unit is present in the data storage unit 12. What is meant is that a direct representation of the condition of the textile machine or representation of the effective winding time of all the winding stations is also present in the acquisition unit. The data storage unit 12 consequently possesses, in effect, a data acquisition unit, no specific structure therefor being further disclosed herein.

The multiplexer 17 is connectible through the data channels SE, Ab and L to every machine unit by means of an address, the common address line of this machine unit, for example SE1, being then grounded through the multiplexer 17.

Within the winding station SP1, a line connection 27 extends from the line L1 of the data Channel L through the diode D1 and the switch S to the address line SE1, and a further line connection 28 from the line Ab1 of the data channel Ab through the signal lamp S1, the diode D2, and the coil of the relay R, also to the address line SE1 of the data channel SE. Connected similarly, but with increasing order numbers of the tap points of the data channels Ab and L, are the other three winding stations of the machine unit 18. The same connecting system also applies to the other machine units with the difference that a separate address line (SE1 to SE4) is assigned to each machine unit.

At the start of the winding process, the desired or nominal time is set at the individual working storage cells of the data storage device 12 for the individual winding stations, that time corresponding to the predetermined thread length when the winding operation is undisturbed and uninterrupted.

The invention is utilized, for example, so that the control unit 14, controlled by the clock 15, reads out a multi-digit address, for example, a twelve-digit address i.e. a twelve-bit digital information, to the multiplexer 17.

From the address information, the multiplexer 17 generates a unit signal, for example the signal SE1. The first machine unit 18 is thereby selected i.e. the address line SE1 is grounded and a current, driven by a nonillustrated d-c voltage source, can flow to one or more winding stations of the selected machine unit through one or more lines of the data channel L. However, a current can flow only if the measured data transmitter has responded i.e. if the switch S of the respective winding station is closed, which is the case when a thread has broken, indicated by the signal "winding station stopped". In the FIGURE of the drawing, the switch S of the winding station SP1 is closed. For this stopped winding station, a zero (0) signal therefor appears on the line L1 of the data channel, due to a voltage drop across the line resistance. Since the data channel L is looped or connected through the multiplexer 17 and the data channel L' to the arithmetic unit 13, the information is also present at the arithmetic unit 13. The arithmetic unit, using suitable, known circuitry, inverts the received information, so that the 0-information becomes 1-information; it then subtracts the unit time value 1 for all running winding stations, from the storage cells of the data storage device 12 which belong to the winding station SP1, and retains the original time value for the stopped winding station SP1. Typical inverting and subtracting circuits are shown respectively in the Sourcebook of Electronic Circuits, page 299 and in Computer Basics, Vol. 4, Digital Computer-Storage and Logic Circuitry, page 232, published by H. Sams, 1962.

Then, the next address is transmitted through the control unit 14 for selecting the next succeeding machine unit, so that the multiplexer 17 transmits the address SE2. The described operation is then repeated to the second and, progressing in steps, to all the other machine units successively.

After all the machine units of the textile machine have been interrogated, the data storage device 12 is read or evaluated by the arithmetic unit 13. Those winding stations, of which the corresponding storage location has reached the zero time value after a suitable winding time, have wound up the desired length and are switched off. Since it is advantageous to select the time unit value of one second as the interrogation cycle, the interrogation of all the machine units and the evaluation of all storage locations are completed in the 1-second time interval.

If, for example, the storage location of the winding station SP2 has reached the zero time value, the arithmetic unit 13 determines the address of the winding station from the address of the storage location and, through the multiplexer 17, selects the corresponding machine unit, in this embodiment, the first machine unit 18.

During this process, the line SE1 of the data channel SE is connected to ground. At the same time, the corresponding winding station is selected through a separate part of the multiplexer. For this purpose, the data channel Ab is used. In the illustrated embodiment, the line Ab2 is connected by the multiplexer 17 to a non-illustrated d-c voltage source through the data channel Ab. A current flows through the line connection 28', the signal lamp SL', the diode D2', and the coil of the relay R' which serves as the stopping relay for stopping the winding station SP2. The lighting of the signal lamp SL' indicates to the operating personnel that the winding station SP2 has been shut down by the length measuring device. Through a non-illustrated self-holding device, the optical signal can be maintained even after the tripping pulse of the arithmetic unit or the multiplexer is switched off until the winding station is again set in operation.

Since the switch S is also cloaed when the winding station is shut down, no running signal can occur any longer during the shutdown time. The first running signal appearing again after the stop signal is the signal for the arithmetic unit 3 to set a new desired or nominal time into the storage device, so that the thread of the new coil again has the same length as the thread of the preceding coil.

The purpose and function of the clock 15 indicates the interrogation cycle. If, for example, the interrogation cycle is set at one second, then the clock 15 applies a starting pulse each second to the control unit 14, so that the interrogation cycle is carried out. A second of winding time is then simultaneously provided between the individual starting pulses. The interrogation cycle per se is normally completed even before the lapse of the interval of one second. The device then rests until the next timing pulse. Instead of a pure timing pulse, a machine cycle can also be employed i.e. the pulses can be released, for example, by rotating machine parts.

Deviating from the embodiment of the invention shown in the FIGURE of the drawing, as noted hereinbefore, the interrogation cycle can also be controlled by the machine cycle which directly reflects the speed of the winding process. The timer or clock 15 is then replaced by a machine cycle device. If the machine cycle is itself controlled by a clock or timer, however, a separate machine cycle device is unnecessary and one can continue to use a clock timing device.

As aforementioned, the invention is not limited to the described and illustrated embodiment and numerous other possible circuits and systems are conceivable within the scope of the claims. This also applies particularly to the system or device for the data acquisition and processing.

There are claimed:

1. Apparatus for manufacturing textile coils having a predetermined thread length in a textile machine having a plurality of individual winding stations, comprising means for establishing and storing a nominal value for the winding time of each individual winding station, means for continuously measuring the shutdown time of each winding station, means for adding the shutdown time to the winding time of each said station to provide a total operating time, and means for stopping the respective winding station when the nominal value of total operating time is reached, said means for establishing and storing a nominal value for the winding time including a plurality of storage elements arranged in accordance with the location of each winding station, said means for measuring the shutdown time including switching means providing a signal indicating the shutdown of said winding station and clock means providing timing pulses for starting an interrogation cycle for determining the shutdown time of each individual winding station, said means for stopping the respective winding station including means for sequentially addressing each winding station and means for detecting when said value of total operating time is reached.

2. The apparatus of claim 1 wherein said means for stopping said winding station includes a relay.

3. The apparatus of claim 1 wherein said addressing means is a multiplexer.

4. The apparatus of claim 3 wherein the number of line conductors between said multiplexer and said winding stations is less than the number of winding stations.

5. The apparatus of claim 3 including means for restarting a winding station after it has been stopped because the pretermined thread length had been attained, and means for determining and correcting the nominal value for the working time of the respective work station, said restarting means being actuatable only upon simultaneous actuation of said determining and correcting means.

* * * * *